US005359735A

United States Patent [19]

Stockwell

[11] Patent Number: 5,359,735

[45] Date of Patent: Nov. 1, 1994

[54] SURFACE COATING PROCESS

[76] Inventor: Gregg M. Stockwell, 1513 Via Madrina St., San Diego, Calif. 92111

[21] Appl. No.: 997,327

[22] Filed: Dec. 28, 1992

Related U.S. Application Data

[63] Continuation-in-part of Ser. No. 670,579, Mar. 18, 1991, Pat. No. 5,196,240.

[51] Int. Cl.[5] ..... A41D 27/24

[52] U.S. Cl. ..... 2/243.1; 2/82; 427/121; 427/401; 427/421

[58] Field of Search ..... 427/121, 393.1, 389.9, 427/393.4, 401, 421; 2/82, 243.1, 901, 902

[56] References Cited

U.S. PATENT DOCUMENTS

| | | | |
|---|---|---|---|
| 3,563,842 | 2/1971 | Thomas | 2/82 X |
| 4,215,171 | 7/1980 | Marco et al. | 428/245 |
| 4,255,487 | 3/1981 | Sanders | 427/393.1 |
| 4,259,411 | 3/1981 | Windhager et al. | 427/121 X |
| 4,388,134 | 6/1983 | Long et al. | 156/248 |
| 4,741,050 | 5/1988 | O'Kane et al. | 2/82 X |
| 4,747,346 | 5/1988 | Geel | 427/212 X |
| 5,196,240 | 3/1993 | Stockwell | 427/389.9 |

*Primary Examiner*—Michael Lusignan
*Attorney, Agent, or Firm*—Brown, Martin, Haller & McClain

[57] ABSTRACT

A process for coating a surface includes preparing a coating mixture by mixing a selected solvent with a silicone rubber adhesive sealant and applying the mixture to the surface. The mixture may be applied as a very thin layer to a woven fabric so that the coating layer has pore spaces corresponding to gaps in the weave of the fabric, so as to provide a semipermeable membrane. In another arrangement, the coating material includes hollow microspheres or capillary tubing of various types, so as to provide improved insulation without adding substantial weight to the surface.

26 Claims, 2 Drawing Sheets

SURFACE COATING PROCESS

CROSS-REFERENCES TO RELATED APPLICATIONS

This application is a Continuation-In-Part of application Ser. No. 07/670,579, entitled "A Seamless Body Suit and a Method for Fabricating Same" which was filed on Mar. 18, 1991, now U.S. Pat. No. 5,196,240, patented Mar. 23, 1993.

BACKGROUND OF THE INVENTION

The invention relates generally to surface coating processes and is particularly concerned with a surface coating including rubber material such as silicone rubber and similar rubber materials.

Surface coatings are often applied to fabrics and other surfaces to improve their qualities, for example to provide improved waterproofing and insulating properties. In the case of outdoor clothing and sport wear, any surface coating must be sufficiently flexible and lightweight so as not to reduce the wearer's mobility, while providing the desired thermal insulation. In many coating materials, the thickness of material required to provide the necessary insulation will undesirably reduce the material flexibility.

A wide range of impermeable materials are known in the art suitable for use in the fabrication of special clothing intended to protect the wearer in cold, wet, or otherwise inhospitable environments. The well-known wet suit is a tightly fitting garment worn by cold-water swimmers as protection against the cold temperatures. The wet suit is so-called because it is normally flooded and performs its function by holding a layer of water against the skin of the swimmer. This layer of water is heated to body temperature by body heat and insulates the swimmer from the ambient water temperature because the wet suit prevents circulation of ambient water against the swimmer's skin.

The drysuit is also used by swimmers and divers for protection against the cold water temperature but, unlike the wet suit, is not flooded and performs by insulating the swimmer from the cold water while sealing against flooding. The drysuit generally provides auxiliary heating means and/or thicker insulation means than is necessary with the wet suit because the drysuit has no provision for holding an insulating layer of warm, static water against the swimmer's skin.

A biohazard suit is known in the art for protecting the wearer against exposure to hazardous biological material in the environment. The biohazard suit is sealed against flooding by air or water and attaches to sealed boots, helmet and gloves to completely isolate the wearer from the hazardous environment.

The general bodysuit class of protective wear includes the biohazard suit, the wet suit, the drysuit, and other similar protective wear having requirements for high thermal insulation, low permeability, precise mechanical fit on thee body of the wearer, non-compressibility of the coating under pressure and resistance to accidental breaks and leakage. Other important requirements for this bodysuit class of protective wear is flexibility for wearer mobility, fire resistance, zero buoyancy, suitability for embedded wiring and sensors, and visibility (coloration).

The drysuit and wet suit known in the art consist of layers of neoprene foam rubber or other types of rubber commonly used in drysuits stitched together with appropriate seals or water-tight zippers to permit the wearer to don and doff the suit. The neoprene and rubber foam bodysuit has several well-known disadvantages. The neoprene foam seams are prone to leakage. The neoprene rubber is highly flammable, is prone to UV degradation, is easily breached by abrasion, and is restrictive of wearer mobility because of the thickness required for acceptable thermal insulation values. Moreover, the neoprene foam wet suit is highly buoyant, requiring inconvenient weight belts in underwater use. Similar disadvantages are known for other neoprene and organic rubber foam bodysuits fabricated for use as drysuits and other related applications.

To obtain satisfactory thermal insulation using only neoprene foam rubber, most bodysuits known in the art become so thick that the mobility of the wearer is seriously impaired. Also, the well-known mechanical vulnerability of neoprene foam-rubber sheets results in frequent unintentional breach of the bodysuit by abrasion and tearing.

SUMMARY OF THE INVENTION

It is an object of the present invention to provide a new and improved surface coating process which is suitable for coating garments and other items in order to improve their surface qualities.

According to one aspect of the present invention, a surface coating process is provided which comprises spraying a layer of a mixture including a sprayable rubber material onto a surface. A single sprayed layer may be used, or alternatively the sprayable rubber material layer may be alternated with a layer of a different material, such as hollow microspheres or the like, for controlling the thermal conductivity of the product. Alternatively, hollow microspheres or the like may be mixed with the sprayable rubber material before spraying it onto the surface.

The rubber material used in the preferred embodiment of the invention is silicone rubber, which will vulcanize at room temperature. However, other rubber materials which do not require excessive heat for vulcanization may be used such as butyl rubber, urethanes (including polyurethane), PVC and neoprene.

The silicone rubber material may be mixed with other components to form a sprayable mixture. For example, it may be mixed with a coloring agent or pigment for controlling the color of the coating, or with a thixotropic agent for controlling the consistency of the mixture. A suitable solvent will be used to mix the components to a desirable spraying consistency. The amount of solvent used will be dependent on the viscosity of the specific silicone rubber material being used. In one specific embodiment of the invention, a surface coating process is provided which comprises the steps of mixing 100 parts by volume of a first solvent mixture with from 10 to 400 parts by volume of silicone rubber adhesive sealant to form a coating mixture, the first solvent mixture including a solvent selected from the group consisting of medium naphtha, 1,1,1-trichloroethane, trichloroethylene, heptane, toluene, xylene, methyl ethyl ketone, hexane, methylene chloride, methyl chloride, and mixtures of any two or more of the listed solvents, applying a first layer of the coating mixture to a surface, applying a second layer of a different material to the surface, and applying a third layer of the coating mixture on top of the second layer.

The third layer may be coated with another layer of the different material, and the layers may be alternated until the desired overall thickness and thermal conductivity or other desired property is achieved. In a preferred embodiment of the invention, the second layer comprises a coating of hollow, gas-filled bodies such as microspheres or lengths of capillary tubing. The hollow bodies may be of flexible plastics or non-flexible materials such as ceramics, glass, crystalline silica, and various metals. Alternatively, the second layer may be of metal or solid metal spheres in order to provide a conductive layer, if desired. In another alternative, hollow, gas-filled bodies may be mixed with the coating mixture prior to application, and the mixture may be applied as a single layer of the desired thickness.

By providing alternate layers of the coating mixture and hollow, gas-filled bodies, the thermal conductivity of the coating can be reduced without substantially increasing the surface thickness or weight. In the preferred embodiment of the invention, the coating layers are applied to a substrate of any selected fabric. Preferably, a fabric having good stretch qualities is used, such as nylon/Spandex®, nylon/Lycra®, tricots, and other similar fabrics having little surface texture and equivalent stretch qualities. Since the hollow gas-filled bodies such as microspheres have little weight, they do not add substantially to the fabric weight nor reduce its flexibility or stretch, and the hollow microsphere layer or layers will reduce thermal conductivity and are also non-compressible.

The microspheres may be coated with metal or may be solid or hollow metal microspheres in order to increase thermal conductivity if desired, for example in cases where heat is to be conducted out of a device as quickly as possible. In this case, the coating process would be suitable for coating orthopedic braces or the like. Other materials which may be included in the coating mixture instead of or in addition to microspheres are metal-coated platelets of glass or similar materials, metal-coated fibers, metal shavings, or combinations thereof.

Additionally, where layers of conductive metal or metal coated microspheres or solid metal microspheres are used to provide one or more electrically conductive layers, the layers may be connected to a suitable power supply to heat the coated surface. This allows garments to be made with in-built heating devices to create heat for the wearer of the item. This would be advantageous, for example, in heated clothing for use in above and below water cold conditions.

According to another aspect of the present invention, a fabric coating process is provided which comprises the steps of applying a thin coating layer of a sprayable rubber material to a woven fabric having gaps in the weave of the fabric, the coating layer having pore spaces at least over some of the gaps in the fabric weave so that the fabric is not completely covered by the coating layer.

The resultant coated fabric will be breathable and will allow water vapor to pass from the non-coated side of the fabric and out through the weave gaps and aligned pore spaces in the coating layer. At the same time, the coated fabric will be waterproof from the coated side. Preferably, the fabric is a stretchable fabric such as circular knits, four way stretch fabrics, smooth nylon/Spandex®, nylon/Lycra®, tricots, and similar materials. With the coating layer applied so as to leave pore spaces as described above, the coating will be stretchable with the fabric, the pore spaces opening wider to accommodate the fabric stretching. Thus, a substantially waterproof coated stretchable fabric can be provided, which could be used, for example, in sport wear garments such as bike, running and work-out wear, camping products, sleeping bags and ski wear. The coated fabric may also be used as a filtering or sieve material, or in stretchable bandages, for example.

The sprayable material may be made by mixing 100 parts by volume of a first solvent mixture including at least one solvent selected from the group consisting of medium naphtha, 1,1,1-trichloroethane, trichloroethylene, toluene, heptane, xylene, methyl ethyl ketone, hexane, methylene chloride, methyl chloride, and mixtures of any two or more of the listed solvents, with from 10 to 400 parts by volume of silicone rubber adhesive sealant to form a coating mixture.

Preferably, in each of the above embodiments, the coating mixture includes a quantity of a thermoset resin colorizing agent to produce a colorized solvent mixture. This enables the color of the coating layer to be selected. Additionally, the mixture may include an ultraviolet stabilizer to provide resistance to ultraviolet light degradation of the coating. Finally, a thixotropic agent may be added if necessary in order to thicken the coating mixture as required for application to the substrate. Where the coating mixture is applied as a spray, thickening will normally be necessary to ensure proper coating consistency.

The coating process according to the first aspect of the invention is suitable for a wide variety of fabrics and other non-fabric or solid surfaces, and both processes may be used in making various products. The process allows a coating of selected thermal conductivity and other properties to be applied relatively easily and economically. Where the coating is applied to a fabric, high thermal insulation can be provided without sacrificing flexibility or mobility. If the mixture is used to coat a garment, a seamless construction results, to preserve impermeability to moisture and other contaminants, providing a custom fit for every wearer, inherent resistance to UV light degradation and high resistance to accidental breach or leakage through abrasion or tearing, variable thickness and flexibility at the joints for enhanced mobility, high fire resistance, zero or negative buoyancy and complete color and decorative flexibility. Wires and sensors may be embedded within the insulating layers of the suit.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
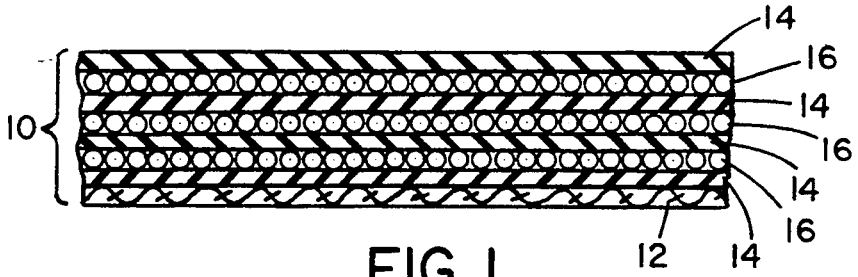
FIG. 1 is a cross-section through part of a coated surface fabricated by a coating process according to a first embodiment of the present invention.

FIG. 1 of the drawings illustrates a layered coating 10 applied to a surface 12 in a process according to a first embodiment of the present invention. The surface 12 may be fabric or non-fabric, and may comprise part of a sheet of material or a ready sewn garment, such as a bodysuit foundation as described in co-pending application Ser. No. 07/670,579, referred to above.

In the embodiment described below, the coating layers are described as being applied to a fabric substrate which may be a sheet of fabric or a made-up garment or other fabric article. However, it will be understood that the coating may alternatively be applied to other surfaces such as orthopedic knee and elbow braces. The layered coating comprises alternating layers of a coating compound 14 and hollow microspheres 16. In FIG. 1 seven layers are applied with the outermost and innermost layer being of the coating compound. However, a greater or lesser number of alternating layers may be used in alternative embodiments, dependent on the desired physical characteristics of the finished coating layer, as discussed in more detail below.

Normally no pre-treatment of the surface 12 will be necessary before applying the coating layers. However, if necessary, the fabric may be treated to remove loose threads by shaving, trimming, chemical treatment, or running through rollers to mat down any loose threads. This can be done before spraying or after first silicone layer is applied. The next step in the process is to spray or otherwise apply a thin layer 14 of a silicone rubber coating compound to the surface 12.

The coating compound should be prepared fresh shortly before application to the surface. If the coating compound is placed in an airtight container, it may be prepared a couple of hours before application. The coating compound may be applied in various different ways, such as by spraying, brushing, dipping, or the like.

The first step in preparing the coating compound is to add a quantity of a suitable solvent such as medium naphtha to a mixing container. The medium naphtha is typically a colorless liquid with a boiling point between 216° F.–274° F., and a specific gravity of 0.8. The second step is to form a second solvent by mixing with the medium naphtha one of the group of solvents consisting of 1,1,1-trichloroethane, trichloroethylene, toluene, heptane, xylene, methyl ethyl ketone, hexane, methyl chloride and methylene chloride. Other secondary solvents with similar characteristics can be used, but one of this preferred group is recommended. In one specific example, 1 part by volume of 1,1,1-trichloroethane and 3 parts by volume of medium naphtha were mixed to form a second solvent suitable as a base for a sprayable compound. These proportions can be adjusted in consideration of the method of application contemplated; whether by spraying, brushing, or dipping, or other. The solvent may be 100% naphtha, 100% 1,1,1-trichloroethane, or any combination of these two solvents or any of the other solvents in the above group.

Following selection or preparation of the solvent, a coloring agent is preferably mixed into the solvent to form a colorized solvent. A thermoset resin coloring agent such as Day-Glo® T-Series and GT-Series pigments, or other coloring agents, may be used. These thermoset resin pigments have a specific gravity of 1.37, an average particle size of about 5 microns by volume, a bulking volume of about 0.0875 gallons per pound, and a decomposition temperature of about 380° F. These pigments are also insoluble in water and hydrocarbons. $TiO_2$ powder may be used as a white pigment because this compound also substantially increases the thermal resistance of the coating compound. Preferably, 2% to 40% by volume of the thermoset resin or titanium dioxide powder is mixed with the solvent, varying the proportion as necessary to obtain the desired color characteristics and intensity.

An ultraviolet (UV) light inhibiting compound is then added to the colorized solvent. The UV inhibiting compound may, for example, be Tinuvin® 292 or one of the hydroxyphenyl benzotriazole UV absorbers such as Tinuvin® 1130. Tinuvin® 292 has a specific gravity of 0.993, a boiling point of 230° C. and does not function by a UV absorption mechanism. Tinuvin® 1130 has a specific gravity of 1.17 and functions as a UV absorber with maxima at 301.6 nm and 340.3 nm. 0.5% to 2% by volume of the UV absorber is mixed with the colorized solvent to form a UV-inhibited colorized solvent.

The next preparation step is the most important one for proper application, adhesion and curing of the coating compound. A thixotropic compound is added to the UV-inhibited colorized solvent. Suitable thixotropic compounds are silicon dioxide formulations such as AEROSIL® 200 or CABOSIL®. AEROSIL® 200 has an average primary particle size of 12 nm, a tamped density of about 40 grams/liter, and consists almost entirely of silicone dioxide ($SiO_2$). For proper application by sprayer, there is a relatively narrow range of thixotropic agent required. One to two parts by volume of the AEROSIL® 200 agent is preferably added to one part of the UV-stabilized colorized solvent to form a thickened colorized solvent suitable for spray application.

The final step in the preparation of the coating compound is the addition of silicone rubber adhesive sealant compound to the thickened colorized solvent to form a sprayable coating compound. Preferably, the proportion of solvent to silicone rubber compound in the mixture is from 1:1 to 8:1 or higher. These proportions can be adjusted where a thinner or thicker coating compound consistency is required for various application techniques. The silicone rubber adhesive sealant compound may be any one part or two-part silicone. However, in the preferred embodiment a silicone rubber adhesive sealant compound of the type manufactured by General Electric Corporation under the RTV designation was used, such as RTV 108 having a specific gravity of 1.05 or IS 808 having a specific gravity of 1.04. Both of these compounds are of paste-like consistency and can be obtained either as a translucent compound or with added color. These particular compounds have a cured elongation rating of 800%, which is preferred for this application. The thermal conductivity of the cured silicone rubber is a low 0.0005 cal/sec/cm$^2$,° C./cm, which is an important advantage where the compound is used as a bodysuit coating, or as a coating for any garment worn in cold conditions.

The above ingredients should be mixed in the specified sequence over a period of two minutes or less and should be agitated continuously, or stirred intermittently in an airtight container, to prevent settling and layering. If exposed to air, this coating compound will set up and cure after about two hours at room temperature and pressure. The set and cure time can be extended somewhat by using an airtight sprayer container and stirring intermittently.

Additional decorative suspensions can be added to the completed coating mixture, or may be applied to the surface of the final coating layer while still wet. These include Mylar® flake, pearl essence, glitter, and the like. These decorative suspensions should be limited to small particle sizes to avoid compromising the strength and integrity of the cured coating.

The exact proportions of the solvent and silicone rubber adhesive sealant as well as the thixotropic agent will also depend on the fabric to be coated. A thinner coating compound can be formulated for tightly woven fabrics of 185 threads per inch or greater, and a thicker application can be used for solid surfaces as well as looser fabric weaves. The compound viscosity must be sufficient to permit proper application by sprayer and yet not so much as to prevent proper wetting of the surface 12. Exact mixture ratios will also differ when airtight storage is employed. A 2.5 to 1 ratio of silicone compound to solvent will give a thinner coating compound suitable for application by sprayer to a nylon/-Lycra® or Spandex® stretch fabric with a tight weave, for example.

Other types of rubber material may be used in a sprayable coating mixture according to other embodiments of the invention. For example, sprayable or flowable silicone rubber materials requiring little or no solvent in the mixture to render it sprayable may be used. It may be necessary in this case to add a small amount of any of the previously listed solvents to the mixture, depending on the viscosity of the specific silicone rubber being used. Suitable silicones for use in a sprayable coating mixture are the following one component silicones produced by Dow Corning: Sylgard 527, Sylgard 567, Sylgard 577, and Dow Corning 96-082, 734, 2106, 93-118, RTV 3110, RTV 3112, RTV 3120, RTV X3-6736, RTV 236. Other suitable silicones are Dow Corning two component silicones such as the following Hipec products: R-6103, Q1-4939, Q3-6646, 6110 and 6134, and the following General Electric one component silicones: GE RTV 118, GE RTV 112, GE RTV 116 and GE RTV 160.

Other types of natural or synthetic rubber material, as well as laminates of silicone rubber with other types of rubber, may alternatively be used in the sprayable coating mixture, with the amount of solvent used being dependent on the flowability of the specific rubber material being used. For example, butyl rubber, urethane, PVC, or neoprene may alternatively be used in the mixture. Preferably, the rubber material is in the 15,000 to 55,000 centipoise viscosity range, and does not require excessive heat for vulcanization.

Figure 2:
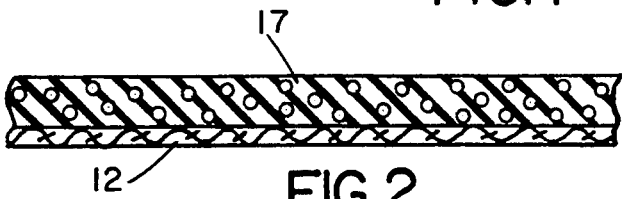
FIG. 2 is a cross-section through a coated surface fabricated by a coating process according to a second embodiment of the present invention.

Instead of providing alternate layers of the silicone rubber mixture and hollow microspheres, the microspheres may alternatively be mixed directly with the silicone rubber mixture prior to spraying onto substrate 12 to form a single layer 17 of the desired thickness, as illustrated in FIG. 2. Only one layer may be used, or the layer 17 containing microspheres may be alternated with layers of the coating mixture without microspheres if desired.

Figure 7:
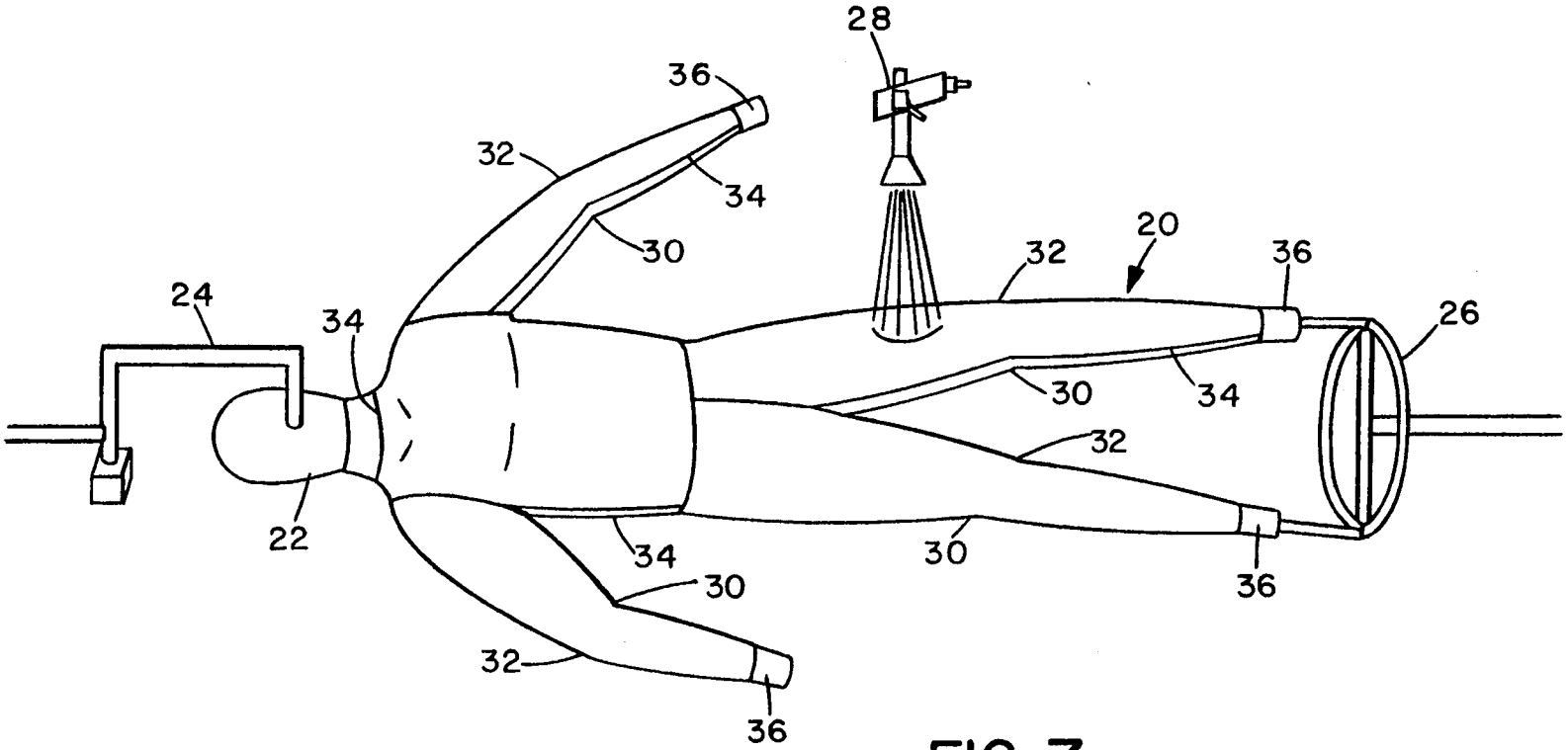
FIG. 7 illustrates one technique for application of one of the coating layers of FIG. 1 or the coating layer of FIGS. 2 or 4 to a bodysuit foundation.

FIG. 7 shows mannequin 20 covered with bodysuit foundation 22 made up of a stretch fabric such as spandex or lycra. Two metal supports, 24 and 26 are shown supporting mannequin 20 in the horizontal position. Supports 24 and 26 are configured to permit horizontal rotation of mannequin 20 during the spraying operation. A spray nozzle 28, which can be either manual or automated, is connected to a spray tank containing a recently prepared supply of the coating compound discussed above. Some examples of suitable spraying devices for applying the compound are the Graco Ultra 1500, 1000, 750 or 500 model airless sprayers and the Paasche' Air Gun No. 62, or other low pressure (30 psi) spray.

An important feature of the bodysuit foundation coating method is the capability for varying the coating thickness at various points on bodysuit foundation 22. For instance, the inside knee and elbow joints 30 can be provided with a thinner layer of coating compound and the outside knee and elbow joints 32 can be provided with a thicker coating by means of additional layers or a more direct and steady application. During the application process, all bodysuit foundation seams 34 are sealed over with a continuous layer of silicone rubber, resulting in a completely uniform and seamless surface. Areas which should not be covered, such as embedded compasses, indicators, clocks, and the like, can be masked to prevent coverage. Wrist, ankle and neck edges 36 can be turned under for the spraying process.

Although FIG. 7 illustrates spraying of a bodysuit foundation, it will be understood that the coating compound may be applied to other surfaces or garments in a similar manner, by spraying or by other application methods as discussed above. Once the fabric or other surface 12 has been sprayed with a thin coat of the coating compound or mixture to form the first or innermost coating layer 14, it is covered with a thin layer is of hollow microspheres while layer 14 is still wet and uncured. Alternatively, as illustrated in FIG. 2, the microspheres may be mixed into the coating compound and sprayed directly onto the surface.

Figure 3:
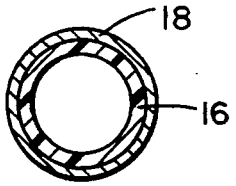
FIG. 3 is a cross-section through a coated microsphere for use in one example of the coating process.

The microspheres 16 may be glass (borosilicate), ceramic, polymer-based plastic, metal, or acrylic based flexible microspheres, and may be coated with a metal layer 18, as illustrated in FIG. 3, for some applications. The metal layer 30 may be a conductive metal such as silver, copper, nickel or aluminum. The microspheres are gas filled, and may be applied by dipping the freshly sprayed article in a bath of microspheres to form an even coat, or by dusting or painting the microspheres onto the uncured coating layer 14. Preferably, layer 16 is one microsphere in thickness, although it may be made thicker than this in some cases. The article is then sprayed with another layer 48 of the silicone based coating mixture 14, and microspheres 16 are applied in the same way as before to the second coating layer to form another microsphere layer 16. The process is repeated until a multi-layered coating having the desired thermal conductivity is achieved, with alternating coating mixture layers and microsphere layers, with the outermost layer being of the coating mixture 14, as illustrated in FIG. 1.

The coating layers 14 may each be cured before applying the next successive coating layer, or the entire layered coating may be cured after all the layers are applied. The silicone rubber based coating mixture of layers 14 may be cured in many ways, including heat application, forced ventilation, UV illumination, high humidity, immersion in hot water, microwave while immersed in hot water, or natural convection at room temperature.

Although microspheres are used in alternating layers 16 or directly in the coating mixture in the above embodiment, in practice any hollow bodies such as lengths of fused capillary tubing such as flexible fused silica tubing, polyimide tubing, and other types of flexible, hollow tubing may be used for layers 14.

The layering or mixing of the coating compound with hollow microsphere layers allows the thermal conductivity of the coating to be controlled without substantially increasing the weight of the article or reducing its flexibility. The hollow microspheres will have very little weight, yet will considerably reduce thermal conductivity. If increased conductivity is desired, for example in situations where heat must be conducted out of an article or device as quickly as possible, the microspheres will be metal or metal coated, or the microsphere layers 16 may be replaced with solid metallic layers. Metallic or metal microsphere layers may be used, for example, where the coating is applied to orthopedic braces. The layered coating 10 may be applied to any surface on any type of article in order to provide improved surface qualities. However, it is particularly suitable as a surface coating for garments of the type worn outdoors in the open air or in or underwater such as diving suits, surfing attire, and chemical protectant suits. The coating layers may be bonded to any chosen fabric, but the fabric preferably comprises stretchable fabric such as nylon/-Spandex ®, nylon/Lycra ®, tricots, circular knit fabrics, four-way stretch fabrics. Alternatively, non-stretch fabrics such as "rip-stop" nylon may be coated in this way. Since the layered coating itself will be stretchable, it will not reduce the stretchability of a coated stretchable fabric.

Figure 4:
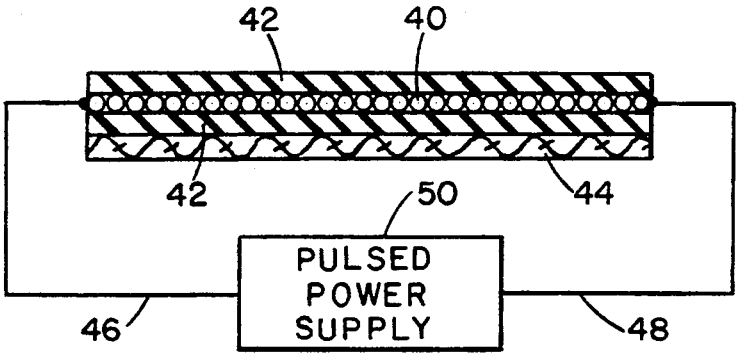
FIG. 4 is a schematic illustration of a heatable coating layer formed in a modified process.

FIG. 4 schematically illustrates a modified example of the layered coating in which a layer 40 of microspheres of conductive metal or having a conductive metal coating 18 as in FIG. 3 is provided between coating mixture layers 42 as the microsphere layer closest to fabric substrate 44. The layer may be continuous or may be provided in some areas of an article and not in others. Electrical leads 46, 48 are connected to the conductive metal microsphere layer 40 at opposite ends of the article, and are connected to a suitable power supply 50 such as a pulsed power supply or other power supplies to heat up the microspheres and provide heat to the wearer of the article. This type of arrangement may be used to provide heated garments for outdoor or underwater wear, such as diving suits, gloves, boots, ski wear, and the like.

Figure 5:
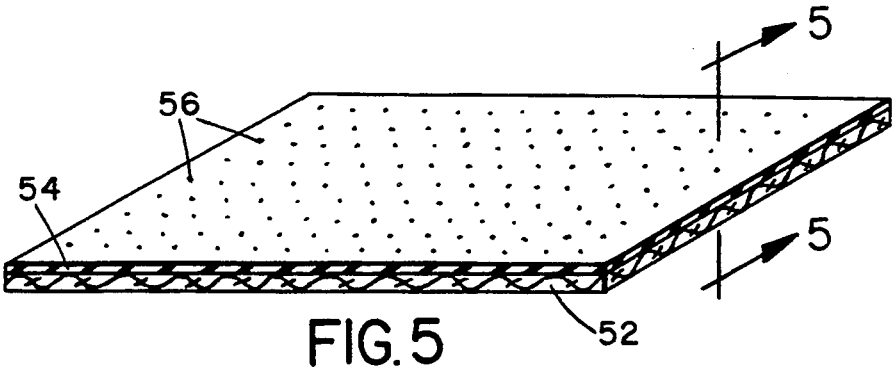
FIG. 5 is a perspective view, partially broken away, of a fabric coated according to a second embodiment of the invention.
Figure 6:
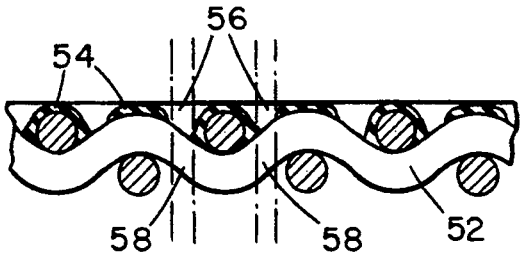
FIG. 6 is an enlarged sectional view of part of the coated fabric of FIG. 5.

FIGS. 5 and 6 illustrate an alternative coating process using the same basic silicone rubber based coating mixture as for the layers 14 in FIG. 1, described above. In FIG. 5, a fabric surface 52 is coated with a very thin layer 54 of the silicone coating so as to leave pore spaces 56 in the coating which coincide with the weave of the coated fabric 52, so that the pore spaces 56 are coincident with the gaps 58 in the fabric weave, as best illustrated in FIG. 6.

Any fabric can be coated in this way, but in the preferred embodiment of the invention the coating is applied to a stretchable fabric such as nylon/Spandex ®, nylon/Lycra ®, tricots, and similar materials. The coating layer itself is stretchable and can therefore stretch with the fabric, with the pore spaces 56 opening wider to accommodate the material stretch. The coated fabric will act as a semipermeable membrane, allowing water vapor to pass from the non-coated side to the coated side through the gaps in the weave and pore spaces 56 in the coating layer. The fabric can be stretched to adjust the pore size, providing a variable sieve. The material will be waterproof from the coated side since the pore spaces will be small enough to prevent water in liquid form from penetrating the coating layer.

A stretchable lightweight fabric material can therefore be provided with a stretchable, waterproof coating which is still breathable for comfort of the wearer. This material will be particularly useful for sporting garments, such as flexible ski wear, bike, running and workout wear, camping and other outdoor wear, raincoats, and so on. It is also suitable for camping products such as tent fabric and sleeping bags. The material would also be suitable for medical soft goods such as bandages, and for filters or sieves.

The coating may be applied to the fabric before it is made up into a desired garment or other article, or the garment or article itself may be coated in a similar manner to the bodysuit as in FIG. 7, or by brushing, painting or dipping the article in the coating mixture. The coating may be provided in any desired color, and with decorative particles suspended in the coating such as glitter, Mylar ® flakes, pearl essence or similar materials to enhance the appearance of the garment.

If additional insulation is necessary, air or gas bubbles may be injected in the coating compound during the application process for producing either the coating of FIG. 1 or that of FIG. 5, by means of a spraying mechanism adapted to injection of air or gas into the spray stream, or by other suitable chemical or heating means known in the art. The presence of microscopic air or gas bubbles entrapped in the silicone rubber coating layer will enhance the thermal and acoustic insulation properties of the layer but may tend to weaken the inherent mechanical strength and is not preferred for applications where durability is required, such as diving suits and other sportswear.

As should be obvious to those skilled in the art, the coating prepared in accordance with the above-described method can be used for any related coating purposes and is not limited to the fabrication of clothing in the manner disclosed herein. For instance, the coating compound can be used in the manufacture of tent fabrics, rain coat fabrics, coated storage drums and in all other applications requiring a variable thickness layer of thermally and acoustically insulated silicone rubber.

The coating material as used in FIGS. 1, 2 and 5 can be made in any desired color. Also, as can be appreciated from the above discussion, colors and decorative effects can be combined and intermeshed by using several sprayers during the coating application process. For instance, a portion of a surface to be coated can be masked during the application of a coating compound having one color and decorative effect and the masked area later coated with another batch of coating compound having a different color and decorative effect while masking the first coated area. Layers of tile or chain mail fabric can be included in the rubber coating for a variety of purposes, such as making a diving suit impervious to penetration by sharks teeth, or providing for a heated fluid layer internal to the coating wall, for example.

Other processes which may be used for coating an article such as a bodysuit or other garment to provide the coating of FIG. 5 include a liquid injection molding process that would use a mannequin as a base and an outer form adapted for placement around the mannequin at a separation equal to the desired suit thickness. The coating compound could then be injected as a liquid under pressure into the interstitial space between the mannequin and the outer form and then cured with the assistance of infrared lights and high humidity provided from inside the mannequin. The outer form could then be cooled and the suit removed from the mannequin.

Another process suitable for fabricating a bodysuit or other garment using the coating compound would use a suction-type mannequin having an aluminum surface with many perforations to permit the application of a vacuum over the entire mannequin surface area. The fabric bodysuit foundation could then be held against the mannequin by suction, with or without sewn seams, and then coated either by spraying or dipping.

The process can be adapted for electrostatic spraying equipment by adding metal flakes or metalized suspensions to the coating compound as part of the colorizing step.

The most effective method for coating a bodysuit having a precise custom fit involves the use of the wearer as a living base in lieu of a mannequin. The wearer could be covered with a plastic liner to protect the skin from contact with the coating compound during the coating step. The fabric bodysuit foundation could then be placed over the lining layer and coated in accordance with any of the suitable methods discussed above.

The coating of FIGS. 1 and 2 incorporating one or more microsphere layers will be suitable for a wide range of different applications, but will be particularly suitable for all types of diving suits, surfing attire, chemical suits, as well as for diving accessories such as boots, gloves and hoods, and for any types of gloves where additional insulation, durability, and reduced thermal conductivity is desirable. When the coating mixture is layered with metal or metallic microspheres, it will be suitable for use as a coating where increased heat conductivity is desirable, such as orthopedic braces.

The above coating method permits the application of a silicone rubber adhesive sealant compound to textiles having weaves of up to 185 threads per inch or more whereby the textile is sealed, insulated and bonded with a tough, impermeable layer of silicone rubber. This silicone rubber layer provides 250% more thermal insulation than the same thickness of neoprene foam rubber. The coating formulation is 500% more resistant to abrasion than neoprene foam rubber and is inflammable at all temperatures below 400° F. The preferred formulation is highly resistant to ultraviolet light damage and can be colored and decorated in many different ways. The thermal insulation properties of the formulation can be further increased with the addition of titanium dioxide powder. Coating suspensions such as Mylar® flakes, pearl essence, glitter, and the like, can be added to the coating formulation for decorating purposes.

The thermal insulation and buoyancy properties of the formulation are particularly suitable for bodysuit coatings, and can be varied by adding entrapped air or gas bubbles during the application process and by adding titanium dioxide to the coating preparation for coloration and thermal insulation purposes. The layered coating formulation may be used for fabrication of many other items such as tent canvas, raincoats, and the like. The formulation is also suitable for anticorrosion sealing or thermal insulation of containers and other objects unrelated to fabrics and textiles.

The thin, single layer, semipermeable membrane coating is also useful in a large number of different applications, although it is particularly suitable for use in all types of sporting wear in view of its stretch properties combined with its breathability and waterproofing qualities.

In either case, the coating mixture allows textiles to be coated with a silicone rubber coating mixture which will bond to the underlying fabric. The coating improves the properties of the surface on which it is bonded and can be colored and decorated in many different ways so that it does not detract from the appearance of a garment, for example, and may even enhance the garment's appearance. The coating is resistant to abrasion and can be designed to provide a desired degree of thermal insulation without detracting from the flexibility of a garment, for example. It is also suitable for coating of solid surfaces. The coating compound is substantially inert and suitable for use in corrosive environments and for exposure to chemicals.

Although some preferred embodiments of the invention have been described above by way of example only, it will be understood by those skilled in the field that modifications may be made to the disclosed embodiments without departing from the scope of the invention, which is defined by the appended claims.

I claim:

1. A process for coating a surface of a substrate, comprising the steps of:

forming a sprayable rubber material; and applying a coating to completely cover one side only of a substrate to form at least one coating layer of selected thickness on top of the surface of the substrate, the coating including at least one layer of the sprayable rubber material and a plurality of hollow, gas-filled bodies.

2. The process as claimed in claim 1, wherein the step of forming a sprayable rubber material comprises mixing a selected rubber with sufficient solvent to render the rubber material sprayable.

3. A process for coating a surface, comprising the steps of:

forming a sprayable rubber material;

applying the rubber material onto a surface so as to form a first layer completely covering the surface;

applying a layer of hollow gas-filled bodies to the first layer while the first layer is still wet so as to completely cover the first layer with a second layer of thickness equal to that of one gas-filled body; and repeating the steps of applying the sprayable rubber mixture and gas-filled bodies in alternating layers to the surface to form a coating of selected thickness on top of the surface.

4. A process for coating a surface, comprising the steps of:

forming a sprayable rubber material;

mixing a plurality of hollow, gas-filled bodies into the sprayable rubber material mixture;

applying the mixture of sprayable rubber material and gas-filled bodies as a coating of selected thickness to completely cover a surface.

5. The process as claim in claim 1, wherein the gas-filled bodies are hollow microspheres.

6. The process as claimed in claim 1, wherein the rubber material is selected from the group consisting of: silicone rubber, urethane, polyvinyl chloride and natural rubber.

7. The process as claimed in claim 2, wherein the step of forming the sprayable rubber mixture comprises forming a selected quantity of a first solvent, the first solvent including at least one solvent selected from the group consisting of medium naphtha, 1,1,1-tricholoroethane, trichloroethylene, toluene, xylene, methyl ethyl ketone, hexane, methylene chloride, methyl chloride;

mixing 100 parts by volume of said first solvent with from 10 to 400 parts by volume of silicone rubber adhesive sealant to form a coating compound; and stirring or agitating said coating compound in a container to form said sprayable mixture.

8. The process as claimed in claim 1, including the steps of:

applying a first layer of the sprayable mixture to a surface;

applying a second layer of a different material to the first layer; and applying a third layer of the sprayable mixture to the second layer.

9. The process as claimed in claim 7, wherein the step of forming the first solvent comprises mixing two or more of the solvents.

10. The process as claimed in claim 2, wherein the step of forming the sprayable mixture comprises mixing 100 parts by volume of at least one solvent with up to 50 parts by volume of a selected colorizing agent to form a colorized solvent, and mixing said colorized solvent with said rubber material.

11. The process as claimed in claim 10, wherein the step of forming the first solvent further comprises mixing 100 parts by volume of said colorized solvent with from 0.5 to 2.0 parts by volume of an ultraviolet (UV) stabilizer to form a modified colorized solvent.

12. The process as claimed in claim 11, wherein the step of forming the first solvent comprises the further step of mixing 100 parts by volume of said modified colorized solvent with up to 400 parts by volume of a thixotropic agent to form a thickened colorized solvent.

13. The process as claimed in claim 1, wherein the hollow, gas-filled bodies are selected from the group consisting of: flexible plastic microspheres, ceramic microspheres, glass microspheres, crystalline silica microspheres, metallic microspheres, metal coated microspheres, and flexible hollow capillary tubing.

14. The process as claimed in claim 8, wherein the material in the second layer is an electrically conductive material.

15. The process as claimed in claim 14, including the step of connecting the second layer to a supply of electricity for heating the layer.

16. The process as claimed in claim 1, wherein the step of applying the first coating layer to a surface comprises applying the coating mixture to a selected fabric surface.

17. The process as claimed in claim 16, wherein the fabric is a stretchable fabric.

18. The process as claimed in claim 2, wherein the step of forming the sprayable mixture comprises mixing 100 parts by volume of the first solvent with from 10 to 30 parts by volume of a silicone rubber adhesive sealant.

19. A process for coating a surface, comprising the steps of:

forming a sprayable rubber material;

applying a first layer of the sprayable rubber material to the surface; and applying a second layer on top of the first layer, the second layer comprising a plurality of particles formed at least partially of electrically conductive material to form at least one electrically conductive layer separated from the surface by the rubber material layer.

20. A seamless, one-piece garment, comprising:

an inner foundation layer of textile material for covering part of a wearer's body including at least part of the torso, the inner layer comprising a plurality of pieces of said material secured together along seams;

a continuous coating completely covering said inner layer including said seams to provide a seamless outer layer;

the coating including at least one layer of sprayable rubber material; and the coating including a layer of hollow, gas-filled bodies on top of said one layer.

21. The garment as claimed in claim 20, wherein the coating thickness is varied over the area of the foundation layer.

22. The garment as claimed in claim 21, wherein the foundation layer includes arm and leg portions for extending over the arms and legs of a wearer including the arm and leg joints, and the coating is of reduced thickness at the inside joint regions to accommodate bending motion at the joints of a wearer.

23. The garment as claimed in claim 22, wherein the coating is of increased thickness at the outside joint regions for enhanced resistance to wear during motion of the wearer.

24. A seamless, one-piece garment, comprising:

an inner foundation layer of textile material for covering part of a wearer's body including at least part of the torso, the inner layer comprising a plurality of pieces of said material secured together along seams;

a continuous coating completely covering said inner layer including said seams to provide a seamless outer layer;

the coating including at least one layer of sprayable rubber material; and said coating including a plurality of hollow, gas-filled bodies mixed into said rubber material.

25. The garment as claimed in claim 24, wherein the foundation layer forms a bodysuit shape for enclosing the torso, arms and legs of a wearer having a neck opening, wrist openings and ankle openings.

26. A seamless, one-piece garment, comprising:

an inner foundation layer of textile material for covering part of a wearer's body including at least part of the torso, the inner layer comprising a plurality of pieces of said material secured together along seams;

a continuous coating completely covering said inner layer including said seams to provide a seamless outer layer;

the coating including at least one layer of sprayable rubber material; and said coating further including a layer including a plurality of particles of electrically conductive material forming an electrically conductive layer on top of said rubber material layer.

* * * * *